United States Patent [19]

Redon

[11] 4,137,435

[45] Jan. 30, 1979

[54] LOAD LIMITER

[75] Inventor: Georges Redon, Orleans, France

[73] Assignee: Societe Anonyme dite: Alsthom-Unelec, Paris, France

[21] Appl. No.: 877,853

[22] Filed: Feb. 15, 1978

[30] Foreign Application Priority Data

Feb. 24, 1977 [FR] France ..... 77 05428

[51] Int. Cl.[2] ..... H01H 3/02

[52] U.S. Cl. ..... 200/85 R

[58] Field of Search ..... 73/143; 200/85 R, 153 T, 200/161

[56] References Cited

U.S. PATENT DOCUMENTS 3,976,851 8/1976 Redon ..... 200/85 R

*Primary Examiner*—Anthony V. Ciarlante

*Attorney, Agent, or Firm*—Haseltine, Lake & Waters

[57] ABSTRACT

The invention relates to a load limiter for lifting apparatus which triggers an electric signal when a vertical tensile stress exceeds a predetermined threshold, the constitution of said load limiter allowing a smaller lost height. The limiter according to the invention is characterized by the fact that it comprises two blocks which extend horizontally on either side of a narrow common portion which forms a pivot so as to delimit a free space extending between the two essentially vertical facing surfaces of said blocks and at whose open end said elastic system is disposed horizontally and in that two fixed supports are provided on either side of said common portion to bend said load limiter. Application to electrical lifting devices such as hoists.

8 Claims, 5 Drawing Figures

LOAD LIMITER

The invention relates to load limiters and more particularly to those intended for lifting apparatus such as hoists.

It is known to produce a load limitor for lifting apparatus which triggers an electric signal when the vertical tensile stress exceeds a predetermined threshold. Such a limiter has a load-sensing element which comprises a generally U-shaped member having substantially rigid arms in the form of two parallel and generally rectangular blocks which are interconnected by a relatively narrow, resilient bridge portion forming a resilient pivot between the blocks. The free ends of the blocks are interconnected by a strip of resilient metal which is twisted in the middle in such a way as to draw its ends towards one another. One end of an actuator arm is mounted on the middle twist and it engages a micro-switch at its other end. Thus at some threshold of applied load the ends of the arms pull sufficiently far apart to untwist the strip a little, which has the effect of actuating the micro-switch.

The applicant's patent No. 31 317/75 (U.S. Pat. No. 3,976,851) describes such a load-sensing element which is placed in series between an anchor point for the hoist and a point from which the hook is suspended. Thus the applied load acts directly to separate the ends of the arms.

This apparatus has however some limitations, in particular with respect to the lost height (distance between the fixing point and the highest point of the hook); indeed, a disposition of the limiter adjacent to the fixed point with moreover the necessary distance for the connection to the suspension beam which is articulated on the frame of the lifting apparatus, does not make it possible to reduce the lost height below a certain amount; now, it is well known that the lost height remains one of the fundamental characteristics for the user.

Preferred embodiments of the present invention provide a load limiter whose construction allows a much smaller lost height than before, while still having a simple and economical design with a view to mass production.

The load limiter according to the invention is characterized in that the two blocks extend horizontally on either side of the common portion so as to delimit a free space extending between the two essentially vertical facing surfaces of said blocks and at whose open end said resilient strip is disposed horizontally and in that two fixed support points are provided on either side of said common portion to bend said load limiter.

The load limiter may also have at least one of the following characteristics:

the two fixed supports are aligned horizontally;

the two fixed supports are constituted by pins which make said limiter integral with the suspension beam which is articulated on the frame of the lifting apparatus;

the two fixed supports are constituted by trunnions which protrude laterally from said limiter, extending each block, so that said limiter itself constitutes a suspension beam which is articulated by said trunnions on the frame of the lifting apparatus, the two blocks with their common portion and the two protruding trunnions constituting a one-piece assembly with a substantially constant thickness, the common portion which connects the two blocks and the hitching point of the cable on one of said blocks are situated on either side of a vertical plane which is at an equal distance from the two fixed supports;

the common portion connects the two blocks together at their upper portion so as to define an essentially rectilinear horizontal upper edge of said limiter; and the common portion is situated substantially in the alignment of the fixed supports.

Two embodiments of the invention are described by way of example with refereence to the accompanying drawings in which.

Figure 1:
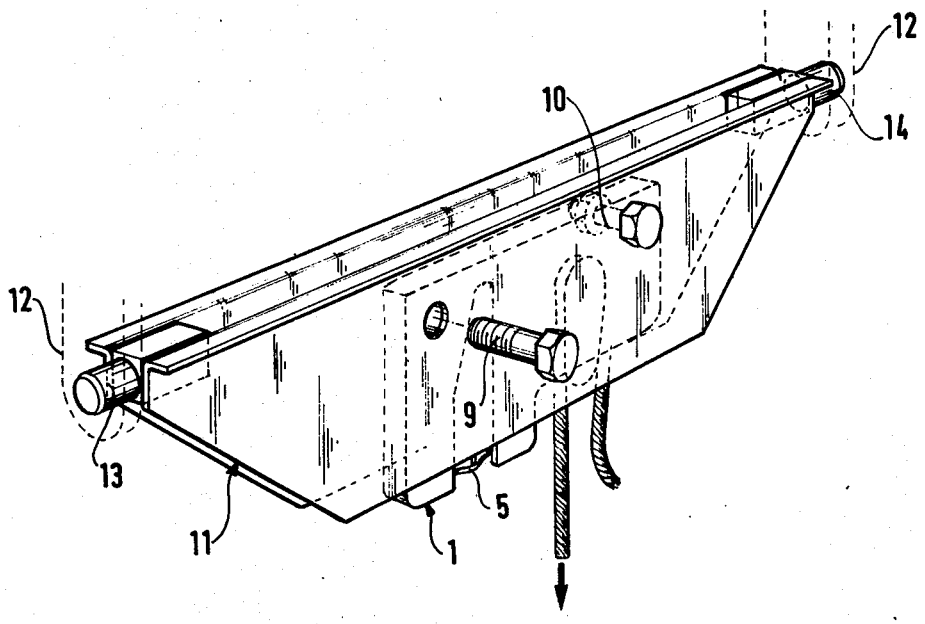
FIG. 1 is a perspective view of a load limiter in accordance with the invention installed on a suspension beam.
Figure 2:
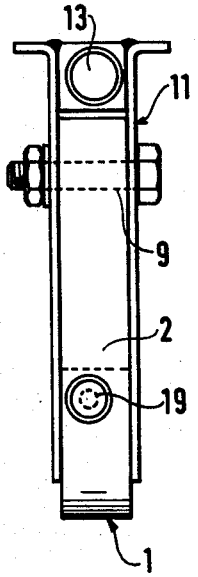
FIGS. 2 and 3 are respectively profile and front views of the load limiter shown schematically in FIG. 1.
Figure 3:
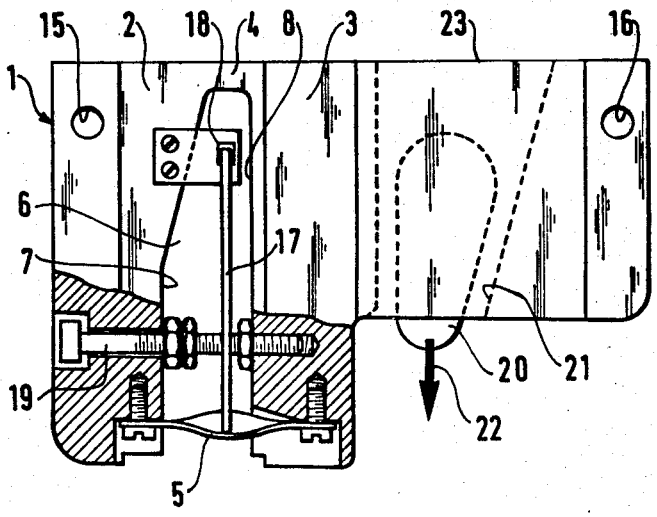

In FIGS. 1, 2 and 3, a load limiter 1 is provided for triggering an electrical signal when a verticial load exceeds a predetermined threshold. Its essential load-sensing component comprises two parallel, substantially rigid blocks 2 and 3 of generally rectangular shape which are connected together at one end by a narrow resilient bridge portion 4 which forms a pivot between the blocks 2 and 3. The blocks 2 and 3 and the bridge 4 are made of a single piece of steel but they could be assembled from separate pieces. The free ends of the blocks 2 and 3 are interconnected by a strip 5 of resilient metal which is twisted at its middle in such a way as to cause an arm 17 to operate a micro-switch 18 to trigger said signal when the movement of the blocks 2 and 3 which results from the applied load reaches the threshold. In accordance with the invention, the two blocks 2 and 3 extend horizontally on either side of the common portion 4 so as to delimit a free space 6 extending between the two essentially vertical facing surfaces 7 and 8 of the respective blocks 2 and 3 and at whose open end the reilient strip 5 is disposed horizontally. Two fixed supports are provided on either side of the common part so that the load limiter bends, beam-like under load.

In accordance with the first embodiment illustrated in FIGS. 1, 2 and 3, the two fixed supports are constituted by pins 9 and 10 which make the load limiter integral with a suspension beam 11 which is articulated on a frame 12 of a lifting apparatus by trunnions 13 and 14. Thus, the limiter has two orifices 15 and 16 intended to receive the respective pins 9 and 10. In a way analogous to that of the load limiter described in the above-mentioned French patent application, the arm 17 is fixed on the resilient strip 5 and is used for actuating the micro-switch 18 which is fixed for example to the block 2. A safety bolt 19 is provided between the blocks 2 and 3, with an operational clearance allowing the required relative movement between said blocks. A removable blocking wedge 20 is used for blocking a lifting cable by co-operaton with a removable cam 21 under the action of a load symbolized by an arrow 22.

Thus, the disposition adopted for the load limiter is no longer in series but in parallel, relying on the principle of a simple bending of said limiter which rests on two fixed supports. Its size in the load direction — and hence the lost height of a hoist using it — is considerably decreased.

It is always an advantage to be able to have maximum clearance for the arm 17 which pivots in a substantially vertical plane; for this purpose, the constitution of the load limiter must allow optimum dimensioning of the free space 6 extending between the two blocks 2 and 3. Thus, the common part 4 advantageously connects said blocks together at their upper part, so as to define an essentially rectilinear horizontal upper edge 23, this also having the effect of simplifying one-piece manufacture of the main part of the limiter.

Such an installation of the load limiter on a suspension beam is entirely compatible with the use of different sizes of beam according to the capacity of the drum of the lifting apparatus.

Figure 4:
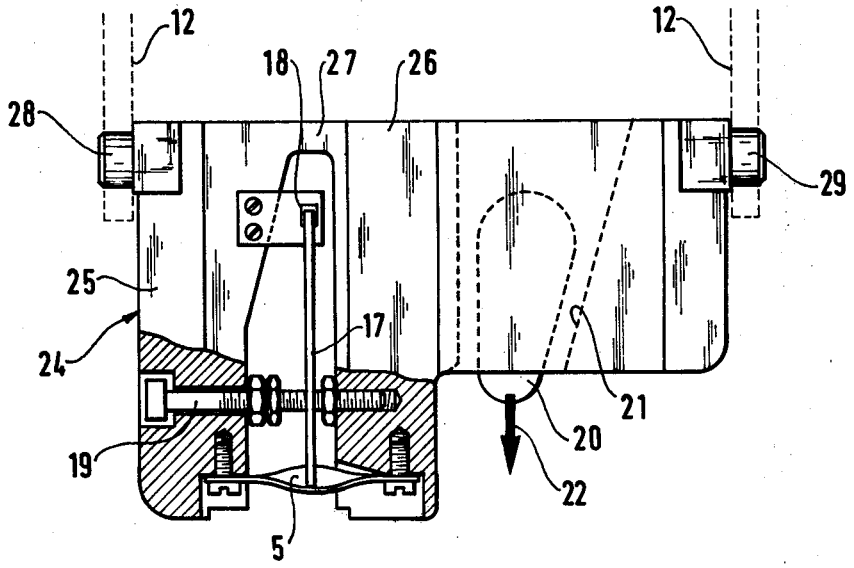
FIGS. 4 and 5 are respectively a front view and a bottom view of an embodiment of a load limiter which also forms a suspension beam.
Figure 5:
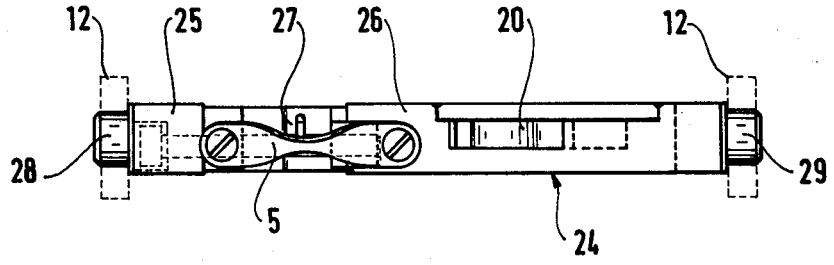

Another embodiment of the load limiter in accordance with the invention makes it possible to simply further the disposition of the limiter and suspension beam assembly. It relies on the same principle of a parallel disposition of the load-sensor and the hitching point with bending of said limiter between its two fixed supports. Such an embodiment has been illustrated in FIGS. 4 and 5: the limiter 24 comprises also two blocks 25 and 26 which extend horizontally on both sides of the narrow common portion 27 and connected by a resilient strip 5, as well as other components which bear the same references as in the preceding figures. Contrary to the preceding embodiment, the fixed supports are constituted by trunnions 28 and 29 which protrude laterally from the load limiter extending the respective blocks 25 and 26 so that the said limiter itself constitutes a suspension beam which is articulated by said trunnions on the fram 12 of the lifting apparatus, this appreciable simplifying the production of the limiter and suspension beam assembly by making the same part fulfill the function of the two previous parts. The two blocks 25 and 26 with their common portion 27 and the two protruding trunnions 28 and 29 advantageously constitute a one-piece assembly with a substantially constant thickness.

In order to have the maximum assembling possibilities, it is preferable for the common portion (4 or 27) which connects the two blocks together and for the hitching point of the cable on one of said blocks to be situated on either side of the vertical plane which is equidistant from the two fixed supports.

It is self-evident that the present invention is not limited to the example which have been given thereof by way of illustration, but covers any embodiment which satisfies the definitions of the claims. Details of constitution can thus change according to the requirements of use: the two fixed supports can be aligned horizontally or be slightly shifted and the common portion which connects the two blocks together can, if required, be situated substantially in the alignment of the fixed supports along a single horizontal line.

What is claimed is:

1. A load limiter for lifting apparatus for providing an electrical signal representative of a limiting load, the load limiter comprising a load-sensitive element and a hitching point disposed side by side between support points such that the application of a load to the hitching point tends to bend the load limiter beam-like between its support points, the load sensitive element being constituted by two blocks connected together by a resilient common portion which forms a pivot between the blocks, said blocks delimiting an empty space between facing surfaces, which empty space has an open end that tends to be widened when the load limiter bends beam-like under load, said open end being bridged by a twisted resilient strip that tends to un-twist when tension is applied between its ends and having an actuator responsive to said untwisting under load to actuate an electrical switch thereby providing said electrical signal.

2. A load limiter according to claim 1, wherein the two support points are aligned horizontally.

3. A load limiter according to claim 2, wherein the common portion is situated substantially in the alignement of the fixed supports.

4. A load limiter according to claim 1, wherein the two support points are constituted by pins which make said limiter integral with a suspension beam which is articulated on the lifting apparatus.

5. A load limiter according to claim 1, wherein the two support points are constituted by trunnions which protrude laterally from said limiter, extending each block, so that said limiter itself constitutes a suspension beam which is articulated by said trunnions on the lifting apparatus.

6. A load limiter according to claim 5, wherein two blocks with their common portion and the two protruding trunnions constitute a one-piece assembly of substantially constant thickness.

7. A load limiter according to claim 1, wherein the common portion which connects the two blocks and the hitching point of the cable on one of said blocks are situated on either side of a vertical plane which is equidistant from the two support points.

8. A load limiter according to claim 1, wherein the common portion connects the two blocks together at their upper portion so as to define an essentially rectilinear horizontal upper edge of said limiter, in use.

* * * * *